US005320179A

United States Patent [19]

Roos, Jr. et al.

[11] Patent Number: 5,320,179

[45] Date of Patent: Jun. 14, 1994

[54] STEERING SUB FOR FLEXIBLE DRILLING

[75] Inventors: Albert E. Roos, Jr., Houston; Roger C. Leaf, Fresno; Frederick J. Pittard, Jr., Richmond, all of Tex.

[73] Assignee: Slimdril International Inc., Houston, Tex.

[21] Appl. No.: 925,100

[22] Filed: Aug. 6, 1992

[51] Int. Cl.[5] ..... E21B 47/022

[52] U.S. Cl. ..... 175/26; 175/45; 175/61; 175/76; 166/65.1

[58] Field of Search ..... 175/26, 45, 50, 61, 175/62, 73, 76; 166/250, 65.1

[56] References Cited

U.S. PATENT DOCUMENTS

| | | | |
|---|---|---|---|
| 4,616,705 | 10/1986 | Stegemeier et al. | 166/60 X |
| 4,858,705 | 8/1989 | Thiery | 175/73 |
| 4,901,804 | 2/1990 | Thometz et al. | 175/40 |
| 5,148,876 | 9/1992 | Wilson | 175/76 |

*Primary Examiner*—Terry Lee Melius
*Attorney, Agent, or Firm*—Neal J. Mosely

[57] ABSTRACT

A flexible steering sub is disclosed for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like. The flexible sub comprises an elongated housing having a plurality of housing sections connectable at one end to an orientation sub for a PDM drill and connectable at the other end to a wire line connector. An electronics assembly including guidance directional sensors and probe is positioned in a plurality of the housing sections, interconnected electrically, and connected at one end to the wire line connector. Selected housing sections spaced along the length of the housing have portions intermediate their respective ends of sufficiently reduced outside diameter to bend in preference to bending of the housing sections containing the electronics assembly. The steering sub is operable during drilling to bend along its length at the reduced outside diameter housing sections on a short radius without bending the electronics assembly.

26 Claims, 4 Drawing Sheets

FIG. 1-O

STEERING SUB FOR FLEXIBLE DRILLING

FIELD OF THE INVENTION

This invention relates to new and useful improvements in steering subs for horizontal drilling at substantial depths in the earth.

BRIEF DESCRIPTION OF THE PRIOR ART

Horizontally recompleting an existing well can provide substantial economic benefits, i.e., increased production and reduced drilling costs. Specialized horizontal well bottom-hole assemblies developed by SlimDril International, Inc. operate in small casing sizes and utilize ordinary drill pipe and conventional drilling rigs. Many horizontal wells have been successfully competed using this system.

In 1985, SlimDril provided the tools for the first medium-radius Austin Chalk horizontal well ever drilled out of an existing well containing 5.5 inch casing. Over 4000 wells in the Austin Chalk contain 5.7 inch or smaller casing. Prior to the development of this system, horizontal wells could not be sidetracked from these vertical Austin Chalk wells. This slimhole technique has found widespread application and has created a drilling boom in the Austin Chalk.

The slim-hole horizontal drilling system is finding widespread use in fractured reservoirs such as the Austin Chalk and in areas where water or gas coning is a problem. In many areas, horizontal wells produce 3 to 8-fold more oil or gas than vertical wells.

Traditional horizontal technology involves the use of highly specialized, bottom hole assemblies. Prior to the development of the slim-hole system high lost-in-hole costs made horizontal recompletions economically unattractive. New horizontal well technology has focused on large-diameter wells and in equipment that can pass through the small diameter casing as found in most Austin Chalk wells.

The SlimDril system utilizes a mixture of existing technology and new innovations. The oil-field SlimDril system is a modification of a small diameter SlimDril steerable drilling system utilized extensively in the construction industry for drilling under rivers and other obstacles for pipeline installations. Modifications to these small diameter systems have produced a reliable, low-cost system for horizontally recompleting oil-field vertical wells in the Austin Chalk and other areas.

Two types of bits are used with this slim-hole system. Side-tracking matrix bits with short gauges and natural diamonds are typically used to kick off from vertical wells. These sidetrack bits are designed to provide a rugged cutting surface while kicking off a cement plug or whipstock.

HT-1 matrix bits utilizing either natural diamonds or thermally stable polycrystalline diamonds are used to drill the horizontal wells once they are kicked off. These bits provide good side cutting, high penetration rates, and long life in the curved sections of the horizontal holes and are designed specifically for use with high-speed mud motors. They virtually eliminate vibration problems experienced earlier with PDC (polycrystalline diamond) bits on high speed motors. In 1985, Austin Chalk wells were drilled at rates of 7 to 10 ft/hr using conventional straight-hole diamond bits, compared to current drilling rates of 10 to 50 ft/hr with the special sidetrack HT-1 TSD bits.

SlimDril uses high-speed, positive-displacement hydraulic Moineau motors for horizontal drilling. These high-performance motors, designed specifically for use in horizontal wells, typically provide twice the power output of older slim-hole motors, resulting in longer life and high penetration rates. Bent housings ranging from 0° to 2¼° are used to vary the build rate. Deflection pads are often installed on the low side of the motors to increase the lateral loads on the bit and to help offset the effect of gravity. The pad thickness is varied as required. Bent subs (0° to 2°) are added above the motor in situations requiring high build rates. Although build rates of 10° to 20° are typically used in horizontal wells, planned build rates in excess of 20° per 100 ft have been achieved.

The SlimDril horizontal drilling system utilizes 350–900 RPM motors. The high-speeds are ideally suited for TSD bits since they produce high drilling rates with low-bit weights which allows the use of slick drill pipe above the motor and eliminates the use of expensive compressive service drill pipe. This is a major advantage, because the high-bit weights required with high-torque, low-speed motor systems necessitates the use of heavyweight drill pipe or compressive service drill pipe to prevent buckling of the drill pipe.

An orienting/circulating sub, containing a spline-key system is made up on the motor with the keyed spline aligned with the motor bend. The key provides a means for proper orientation of the steering tool. The circulating sub by-passes flow above the motor to eliminate tripping wet pipe. The sub remains closed during the drilling operation and is activated by dropping a ball through the drill string when the operation is complete.

A surface recording gyro is used to orient the tool-face direction before kicking off. This wireline tool allows readings of tool-face azimuth and inclination with the tool in the casing since its readings are not affected by magnetic interference. Once the kickoff assembly is oriented, the gyro must be pulled prior to drilling since it cannot survive the drilling vibrations of the motor.

Steering tools are normally used to survey the curved and horizontal portions of the slim-hole while drilling. These wireline tools allow continuous reading of tool-face azimuth and inclination. The azimuth reading is measured with three magnetometers and the inclination is measured with three accelerometers. Measuring while drilling (MWD) tools are sometimes used instead of wireline steering tools in holes larger than 5-in. diameter. Smaller MWD tools are under development for use in small diameter holes.

A drill collar constructed of high-strength, non magnetic monel is used to isolate the steering tool from the magnetic interference of the steel drill pipe located above it. A side-entry sub provides a method of drilling with a wireline survey tool without having to splice the wireline or pulling the survey tool each time a joint of pipe is added to the drill string. The wireline is threaded into the side-entry sub and attached to the steering tool. The steering tool is then run through the drill string and seated into the orienting sub. Drilling commences with the wireline outside of the drill string from the side-entry sub to the surface. Joints of drill pipe can therefore be added to the drill string while drilling without pulling the survey tool.

The horizontal re-entry drilling operation normally takes place in three steps: kickoff, build section, and horizontal section. The kickoff is the most critical part of the operation. An error at this stage can result in major problems since the initial direction is being established during kickoff.

Once the kickoff point has been determined, two different techniques are used for kickoff. The preferred method is to mill out a section of the casing, set a cement plug at the kickoff point, and sidetrack off of the cement plug. Most of the wells drilled with the SlimDril system utilize this procedure.

The second kickoff method is to set a whipstock inside the casing at the kickoff point, mill a window in the casing and then sidetrack through this window. Although this technique may be less costly, it has several disadvantages. Surface recording gyros are normally used to orient the kickoff assemblies since other tools are affected by the magnetism of the steel casing. The gyro is run down the drill string, set in the orienting sub, used to orient the tool-face, and then pulled since it cannot withstand drilling vibrations.

The steering tool is then run down the drill string, set in the orienting sub, and calibrated using the known tool-face orientation. Drilling commences and continues with this bottom hole assembly until all obstructions are cleared and the tool is far enough away from the casing to prevent magnetic interference (approximately 50–100 ft). The kick-off assembly is then pulled and replaced with the angle build assembly in preparation for drilling the build or curve section of the hole.

Tool-face orientation is continually monitored via steering etc. The angle-building assembly is normally the same as the kickoff assembly except that the sidetrack bit is replaced with an aggressive TSD side cutting HT-1 bit or, in very hard formations, with a side cutting natural diamond bit. Time drilling takes place at the start of the kick off assuring an accurate azimuth and inclination with respect to build rate. Tool-face orientation is continually monitored via steering or MWD tools as drilling progresses. If the BHA (bottom hole assembly) is building too rapidly, the tool-face is often oriented back and forth periodically to reduce the vertical build rate. Once the desired angle has been reached (90° for a horizontal hole), the angle-build assembly is pulled.

The angle-holding assembly used to drill the horizontal section of the hole utilizes a bent motor housing with a small angle (1° to 2°) to allow minor corrections to be made to as the horizontal section is drilled. No other angle-build components are typically used in the horizontal assembly. This assembly is used to target depth unless problems are encountered.

This horizontal drilling system has been used successfully in many applications. Numerous horizontal wells have been drilled in fractured reservoirs such as the Austin Chalk and Sprayberry fields. Horizontal wells are more successful than vertical wells in fractured reservoirs because it is difficult to intersect major vertical fractures with vertical wells whereas horizontal wells typically pass through two or three sets of vertical fractures.

This system is also used to drill horizontal wells in reservoirs where gas or water coning is a problem. Horizontal wells have lower draw down pressures than vertical wells, thus allowing the horizontal wells to be produced at much higher rates without pulling gas or water into the well bore. The horizontal wells are placed near the top of the reservoir if only water coning exists, near the bottom if only gas coning exists and near the center if both gas and water coning exists.

SlimDril motors have been used to drill in tight formations and in heavy oil reservoirs. In these fields, the horizontal wells act as pipelines or conduits through the producing formations, greatly increasing formation exposure and production rates. SlimDril tools are also used to drill in inaccessible locations such as in mountainous areas, under rivers or lakes, and under urban areas.

The field results show that this slim-hole horizontal drilling system is reliable and economic in the Austin Chalk and other areas. In most areas, horizontal wells produce 3 to 8 times more oil and gas than vertical wells. The economic benefits of the method are high since the development cost per barrel is less than half that of vertical wells. In addition to increased production rates and reduced drilling costs, these recompletions may result in tax incentives since horizontal reentries are classified as an enhanced oil recovery procedure in many areas.

This slim hole drilling system has been very successful but there has been a need for improvement in the steering portion for drilling holes of substantially shorter radius.

SUMMARY OF THE INVENTION

One of the objects of this invention is to provide a new and improved drilling apparatus for use in drilling holes in the earth of shorter radius than has been available heretofore.

Another object of this invention is to provide a new and improved drilling apparatus with a steering section capable of use in drilling holes in the earth of shorter radius than has been available heretofore.

Another object of this invention is to provide a new and improved drilling apparatus which is more flexible for use in drilling holes in the earth of shorter radius than has been available heretofore.

Another object of this invention is to provide a new and improved drilling apparatus having a steering section which is more flexible for use in drilling holes in the earth of shorter radius than has been available heretofore.

Another object of this invention is to provide a new and improved steering section for horizontal drilling apparatus for use in drilling holes in the earth of shorter radius than has been available heretofore.

Another object of this invention is to provide a new and improved flexible steering section for horizontal drilling apparatus for use in drilling holes in the earth of shorter radius than has been available heretofore.

Another object of this invention is to provide a new and improved segmented and flexible steering section for horizontal drilling apparatus for use in drilling holes of shorter radius than has been available heretofore.

Other objects of the invention will become apparent from time to time throughout the specification and claims as hereinafter related.

BRIEF DESCRIPTION OF THE DRAWINGS

In the drawings, the flexible tool embodying this invention is so long that it takes a large number of Figures to illustrate it.

DESCRIPTION OF THE PREFERRED EMBODIMENT ASSEMBLED FLEXIBLE STEERING TOOL

Figure 1A:
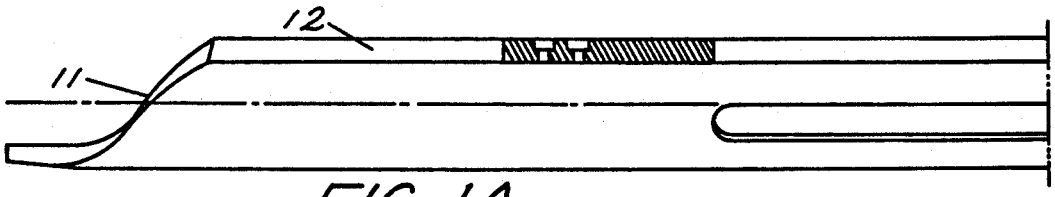
FIGS. 1A through 1P are shown in sequence illustrating successive sections of the tool and taken together constitute a longitudinal center quarter section along the entire length of the tool.

This invention relates to the drawings by numerals of reference, there is shown an improved steering tool or sub which provides more accurate and precise directional drilling. The basic component parts of the redesigned steering tool are illustrated in FIGS. 2A and 2B, with more details shown in FIGS. 1A through 1P. The tool consists of the uphole read-out equipment (not shown), which includes the driller's console, interface box, printer, computer, and line conditioner; and the downhole equipment, which includes the wet connect system, wireline, steering tool running gear, and probe.

The tool, as a whole, is referred to by the reference numeral 10 throughout all of the drawings. At the lower end of the tool 10 is a mule shoe stinger 11 which, when assembled, is keyed to an orientation sub (not shown) on the motor for the PDM drill. The orientation sub (not shown), when assembled, is fitted within the (BHA) bottom hole assembly with the key marking the high side of the bottom hole assembly (BHA). The short radius tool 10 is seated in high side position when the slot 12 on the stinger seats in the key of the orientation sub (not shown).

A lower stabilizer 13 is designed to bend in preference to the pressure barrel sections. The lower stabilizer (which will be described more fully below) uses a main spring that acts against a spring block retainer to enforce the proper arc length of the bow spring members. The bow spring members then translate their calculated optimal force to the inside diameter of the monel collar within which the survey tool is seated.

Lower pressure barrel section 14 and upper pressure barrel section 15 contain the probe. The probe is effectively articulated through the use of a mid stabilizer 16. The mid stabilizer 16 is an articulated sub containing an electronics package which connects both the upper and lower pressure barrel sections 14 and 15. The stabilizer 16 is designed to work in concert with the upper and lower stabilizer units bending in preference to the pressure barrel sections. The mid stabilizer 16 is engineered to withstand an external pressure of 20,000 psi. The mid stabilizer has the ability to withstand high pressure and bend in preference to the pressure barrel sections. A top stabilizer 17 effectively increases the stability of the survey system by decreasing the shock delivered to the upper pressure barrel 15. The stabilizer 17 also encases the electrical connection feed through system which requires a single connect to the wireline to complete the downhole electrical system.

The mule shoe stinger 11 (FIG. 1A) is slotted or keyed at 12 so that it will align itself properly with the high side of the bottom hole assembly once the steering tool has been seated. The locking assembly is used to lock the mechanical alignment tool 18 in proper position once the high side of the probe is aligned with the high side of the mule shoe stinger. The probe as employed by SlinDril International has a computerized high side alignment built into the electronics and software package. The mechanical alignment tool (MAT) 18 (FIG. 1B) is used strictly as back up to the computerized system in case of computer failure or human error. The mechanical alignment tool (MAT) is a corrosion resistant tool 18 and can be run on a long term basis without fear of oxidization due to downhole conditions. The high side tool is used as a mechanical alignment mechanism which gives support to the locking assembly. The mechanical high side tool also acts as a barrier to washout, washout caused by venturi action associated with the drilling mud, the tools resistance to washout being due to its special alloy and placement near the mule shoe stinger.

A sinker bar 19 (FIGS. 1C, 1D and 1E), preferably of brass, is connected above the MAT 18, its length being determined by optimizing the performance of the magnetometers within the electronics package with respect to eliminating magnetic distortion while keeping the electronics package a minimal distance from the bit. The sinker bar 19 is designed to bend in conjunction with the stabilizer units 13, 16, 17 and 18 and in preference to the pressure barrel sections 14 and 15. The turned down sinker bar 19 is used as a means of flexing and sinking the short radius tool down through the drill pipe to its orientation sub located within the bottom hole assembly. The sinker bar 19 will bend prior to threaded tool joints on the short radius directional tool. The sinker bar 19 will also bend prior to the bending of the probe barrel sections 14 and 15. The sinker bar 19 acts as a flexible unit bending in conjunction with the mid articulating stabilization electrical connect sub along with the lower and upper stabilizer connect subs.

The lower stabilizer 13 is also designed to bend in preference to the pressure barrel sections 14 and 15. Lower stabilizer 13 (FIGS. 1E and 1F) comprises a stabilizer pin sub 20 having a portion with wrench flats 21 and a threaded extension 22 threadedly secured in threaded recess 23 in the upper end of sinker bar 19. Stabilized pin sub 20 has an extension 24 extending from the other side of wrench flat portion 21 which is secured inside one end of a hollow support member 25.

Support member 25 has box threads 26 into which the threaded end of extension 24 is tightly threaded. A set screw 27 prevents this threaded joint from separating. The other side of support member 25 receives the male extension 28 of a stabilized box sub 29. Support member 25 has box threads 30 into which the threaded end of male extension 28 is tightly threaded. A set screw 31 prevents this threaded joint from separating. A sleeve member 32 is slidably supported on extension 24 between the end of wrench flat extension 21 and support member 25. A sleeve member 33 is slidably supported on extension 28 between the end of plug member 29 and support member 25.

Sleeve members 32 and 33 have recesses 34 and 35 spaced around the periphery thereof. Bow springs 36 of non-magnetic metal sleeve members 32 and 33 with opposite ends secured by pins 37 and 38 (FIGS. 1E and 1F). A coil spring 39 is compressed between the end face of wrench flat extension 21 and sleeve member 32 urging it against the end of support member 104 and 25 and bowing the bow springs 36 outward to the predetermined arc length.

The tool 10 is positioned in well bore 40 in the earth inside non-magnetic drill collar 41. In the position shown in FIGS. 1E and 1F, the bow springs are bowed outward tightly against the inside diameter of the wall of drill collar 41 and functions as a stabilizing centralizer, as well as permitting this portion of the tool to flex during use. Drill collars 41 are part of the drill string through which the drilling fluid (mud) is pumped to the positive displacement motor which operates the drill bit.

Bottom alignment plug 42 (FIGS. 1F and 1G) is the lower pressure bulkhead for the housing 43 of lower pressure barrel 14. Plug 42 has wrench flats 44 for facilitating assembly and has male extensions 45 and 46 extending into and secured in plug member 29 and the lower end of housing 43 respectively. Plug 42 has a vee scribe 47 to assist in aligning the parts with respect to high side tool for proper operation.

The upper end of bottom alignment plug extension 46 is attached to shock snubber 48 (FIG. 1G) which provides attachment between the electronics and the bottom alignment plug 42. Shock snubber 48 provides radial alignment of the steering tool assembly 10, prevents rotation of the electronics within pressure housing 43 and provides a shock cushion when seating and operating the directional steering tool. The bottom snubber 48 is a commercially available unit obtained from its manufacturer.

Lower pressure barrel 14 is a tubular housing 43 closed at its bottom end by plug extension 46 and at its top end by the lower end plug of mid stabilizer 16 (FIGS. 1F, 1G, 1H and 1-I). Lower pressure housing 43 contains the lower electronics portion of the steering tool 10. Both ends of housing 43 are threaded with fast engaging threads and seals 50 and 51 to protect the electronics package 49 from well pressures and environment. Housing 43 is of beryllium copper alloy which is non-magnetic and can withstand 19,000 p.s.i. external pressure. Electronics package 49 contains the guidance directional sensors. This electronics package comprises one section in lower pressure housing 43 and the other section in upper pressure housing as described below. The electronics package 49 is a commercially available product.

A split probe plug adaptor 52 (FIG. 1H) is supported in the upper end of housing 43. Adaptor 52 is attached by four screws. It houses a multi-pin electrical connector which connects the lower and upper sections of the electronics package 49 by a long high-temperature wire harness 53 which passes through a feed-through sub 54 (FIG. 1-I) and mid stabilizer 16. The feed-through sub 54 is threadedly secured (at 55) in the upper end of housing 43 and sealed by O-rings 51 and 56. Two set screws (not shown) lock and prevent any rotation between parts. The end face 57 of feed-through sub 54 is the bearing load surface for compression spring 58 for mid stabilizer 16.

Mid stabilizer 16 is of an articulated flexible shell construction comprising an elongated inner tubular flex stabilizer sub 59 (FIGS. 1-I, 1J and 1K) through which the wire harness 53 passes to the upper portion of the electronics package 49. The O.D. of the lower end 60 is threaded at 62 to fit the threaded box end of feed-through sub 54 and a smaller extension fits the smaller I.D. of feed-through sub 54 and is sealed by O-rings 63. The parts are secured against rotation and separation by two set screws 64. Flex stabilizer sub 59 has reduced O.D. portions 65, 66, 67 and 68 (FIGS. 1-I and 1J) spaced along its length to define circumferential bosses 69, 70 and 71. The upper end 72 of flex stabilizer sub 59 has an enlarged O.D. sized to fit inside the lower end of the upper pressure barrel 15.

The articulated flexible construction comprises a tubular ball socket sleeve 73 which has an I.D. sized for a loose sliding fit over peripheral boss 69 on stabilizer sub 59. The lower end of ball socket sleeve 73 is counterbored at 74 to retain the upper end of compression spring 58. The upper end 75 of ball socket sleeve 73 has a convex spherical curvature. A bow spring retainer sleeve 76 has an I.D. sized for a loose sliding fit over reduced O.D. portion 66 of stabilizer sub 59 and has a concave spherical curvature (spherically ended) at its lower end 77 mating with the spherically curved end 75 of ball socket sleeve 73 (spherically ended).

Three spacer sleeves 78, 79 and 80 have inside diameters of a size permitting installation over the peripheral bosses 69, 70 and 71 with sleeve 79 having a loose sliding fit with peripheral boss 70 and sleeves 78 and 80 sliding in the spaces defined by the smaller outside diameter portions 66 and 67. An upper bow spring retainer sleeve 81 has an I.D. sized for a loose sliding fit over reduced O.D. portion 67 of stabilizer sub 59 and has a concave spherical curvature at its upper end 82 (soherically ended) mating with the spherically curved end 83 (spherically ended) of an upper ball socket sleeve 84. Tubular ball socket sleeve 84 has an I.D. sized for a loose sliding fit over peripheral boss 71 on stabilizer sub 59. The upper end 85 of ball socket sleeve 84 abuts with a concave surface matching the convex surface of the enlarged O.D. portion 72 to limit further movement of the sleeve.

Lower bow spring retaining sleeve 76 has recesses 86 spaced around the periphery thereof. Upper bow spring retaining sleeve 81 has recesses 87 spaced around the periphery thereof. Convex bow springs 88 are spaced around the articulated stabilizer and have their ends secured in recesses 86 and 87 by pins 89 and 90.

The lower ball socket sleeve 73 and upper ball socket sleeve 84, because of the spherical surface fits with spring retainer sleeves 76 and 81, allow for pivotal movement to put equal load on the bow springs 88. When the apparatus is operating in a short radius section of a well, there is sufficient clearance between the sleeves and the stabilizer sub to avoid interference with the bending thereof. The sleeves 78, 79 and 80 are spacer sleeves which set the space between the bow spring retaining sleeves 76 and 81.

Extension 72 of stabilizer sub 59 is the lower pressure bulkhead for the housing 91 of upper pressure barrel 15. Extension 72 is threaded into and secured in housing 91 and sealed by O-rings 92 (FIGS. 1J and 1K). The upper end of extension 72 encloses the upper end of cable 53 from the lower part of the electronics package. Shock snubber 93 is connected to the extension 72 and provides a shock cushion against high load shocks transmitted through the drill string produced by the PDM and drill bit during drilling that would otherwise go into the steering tool assembly. The upper shock snubber 93 as seen here is a type of elastomer cushion mechanism which protects the upper electronic probe section from sudden shock while it is contained within the upper pressure barrel housing 91. A shock snubber plug adaptor 94 is provided in the lower end of the upper portion of the electronics package 49.

Upper pressure barrel 15 is a tubular housing 91 (FIGS. 1J–1N) closed at its bottom end by plug extension 72 and at its top end by the wire line plug connector 95. Upper pressure housing 91 contains the upper electronics portion 49 of the steering tool 10. Both ends of housing 91 are threaded with fast engaging threads and seals 92 and 96 to protect the electronics package 49 from well pressures and environment. Housing 91 is of beryllium copper alloy which is non-magnetic and can withstand 19,000 p.s.i. external pressure. The upper portion of the electronics package 49 contains power supply and computer sections. This electronics package comprises one section in lower pressure housing 43 and the other section in upper pressure housing 91. The electronics package 49 is a commercially available product.

The upper end connector 97 of electronics package 49 is connected by cable 98 and wire strain relief 99 to the lower end of the pressure bulkhead feed through pin 103 at splice connection 102. The ground wire of cable 98 is connected within the orifice to the external wall of plug 95 by screw 106. Screw 106 is secured in place by passing a screw driver through opening 125 engage and turn the screw. Cable 98 is stabilized against vibration by high temperature anti-vibration boots 100 and 101.

Wire line plug connector 95 has wrench flats 108 for use in making up the tool. The orifice of the plug connector 95 which contains the electrical splice of cable 98 and pressure feed through pin 103 is shown at connection 102. After the connection is made, the orifice 102 is then packed with inert non-conductive dampening putty. The dampening putty is used as a packing agent to eliminate electrical fraying of the lines due to vibration. The dampening putty is then sealed within the orifice 102 around the electrical splice using high temperature tape as an external wrap to the orifice of plug 95.

The pressure bulkhead feed through pin 103, located at the top of wire line plug connector 95 acts as an external 20,000 psi pressure resistant bulkhead seal. The bulkhead feed through pin 103 is secured in the top of plug connector 95 by threaded connection. The feed through pin 103 lower cable end is then passed through anti-vibration insert sleeve 105 to its splice point 102.

The anti-vibration sleeve 105 acts as a buffer between the outside diameter of the lower cable end of pin 103 and the inside cable passage diameter of plug 95. Sleeve 105 thus eliminates potential electrical shorting due to frictional wear between plug 95 and pin 103. The lower cable end of pin 103 is not exposed to external pressure. The top end of pin 103 is exposed to pressure and is connected to the wireline at splice 107.

Cable head housing 111 (FIGS. 1N-1-O) is threadedly secured on the upper end of wire line plug 95 and has an upper end portion or extension 112 which forms the lower part of top stabilizer 17. A bulk head cap 109 is located within top stabilizer 17 at cable head housing 111. The cap 109 protects the wireline 110 from crushing the pressure bulkhead feed through pin 103. Top stabilizer 17 is also designed to bend in preference to the pressure barrel sections 14 and 15. Top stabilizer 17 (FIGS. 1-O and 1P) comprises extension 112 threadedly secured in the lower end of hollow support member 113.

Support member 113 has box threads into which the threaded end of extension 112 is tightly threaded. A set screw 114 prevents this threaded joint from separating. The other side of support member 113 receives the male extension 115 of wire line fishing head 116. Support member 113 has box threads into which the threaded end of male extension 115 is tightly threaded.

A set screw 117 prevents this threaded joint from separating. A sleeve member 118 is slidably supported on extension 112 between the end of cable head housing 111 and support member 113. A sleeve member 119 is slidably supported on extension 115 between the end of wire line fishing head 116 and support member 113.

Stabilizer spring block 104 is supported by extension 112 and positioned between support member 113 and sleeve member 118. The spring block 104 is a spacer which keeps bow springs 122 maximized with respect to the proper friction applied to the inside of collars 41. The length of spacer block 104 is predetermined to set the bowing of springs 122 to maintain an optimum frictional force against collars 41.

Sleeve members 118 and 119 have recesses 120 and 121 spaced around the periphery thereof. Bow springs 122 of non-magnetic metal extend between sleeve members 118 and 119 with opposite ends secured by pins 123 (FIG. 1-O). A coil spring 124 is compressed between the end face of cable head housing 111 and sleeve member 118 urging it against the end of stabilizer support block 104 and bowing the bow springs 122 outward to a predetermined set with respect to the amount of friction placed on the drill collar 41.

OPERATION

Figure 1B:
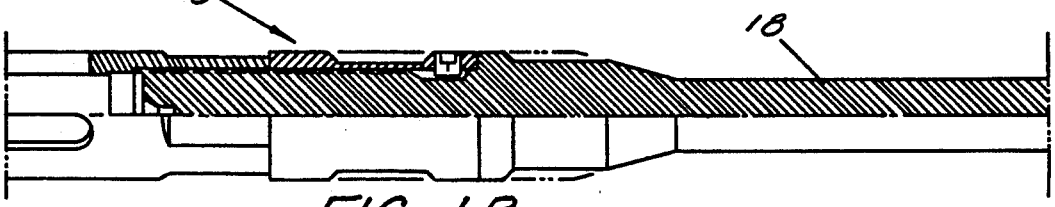
Figure 1C:
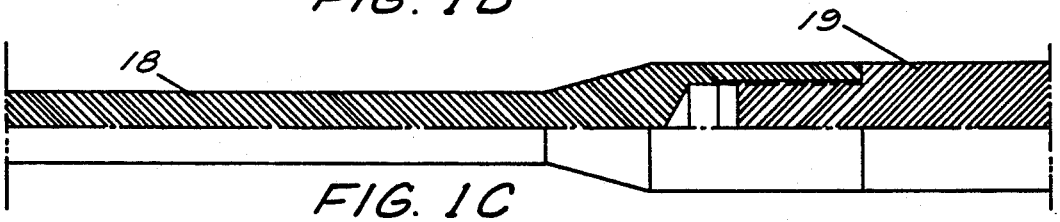
Figure 1D:
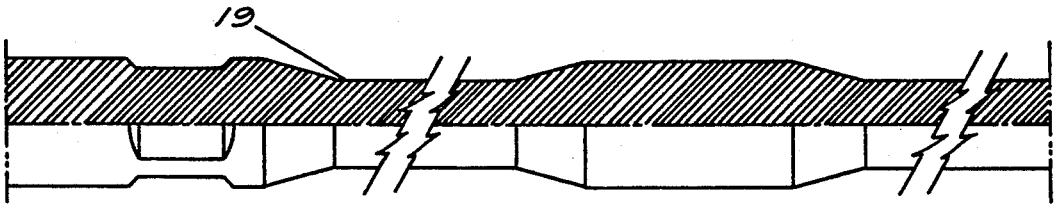
Figure 1E:
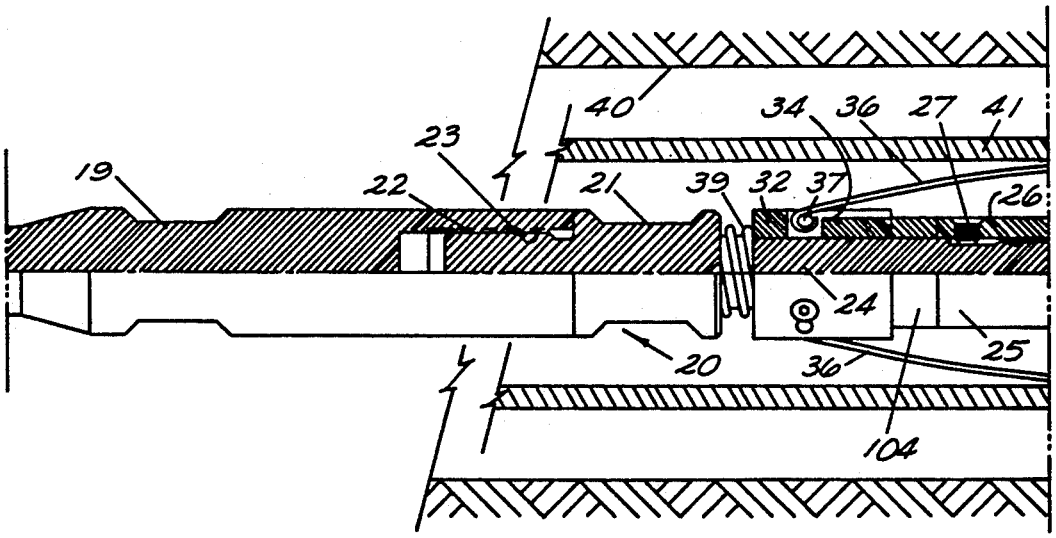
Figure 1F:
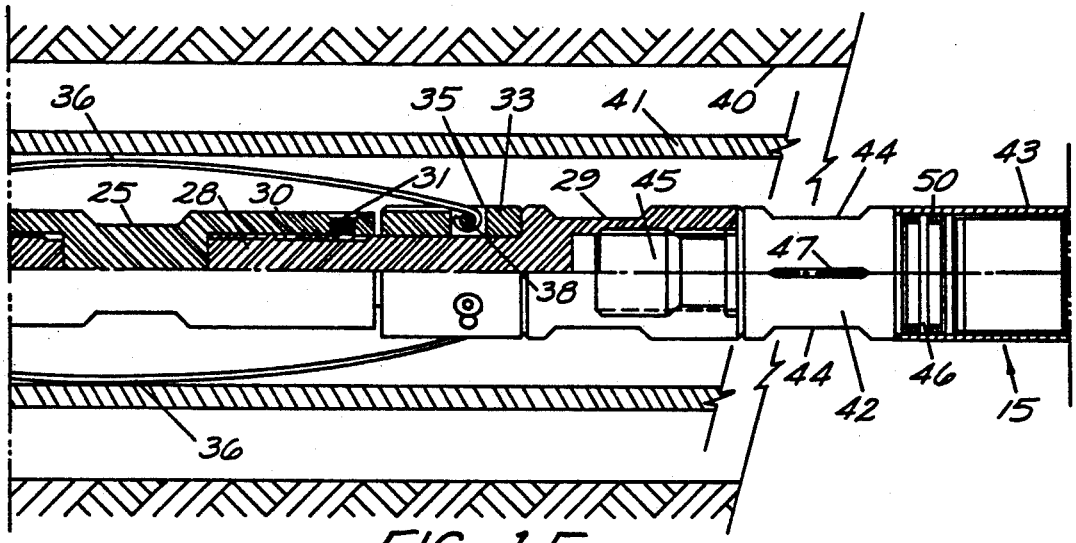
Figure 1G:
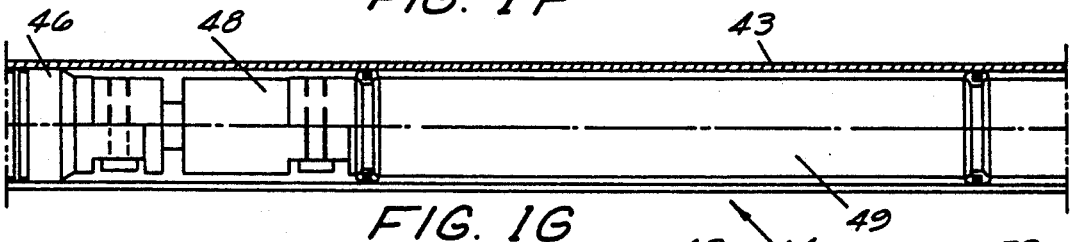
Figure 1H:
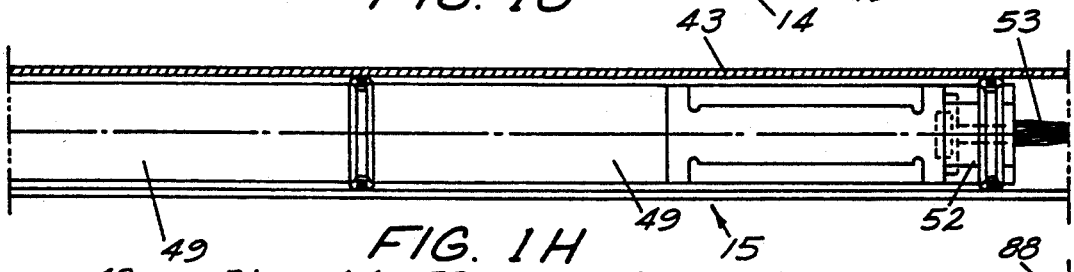
Figure 1I:
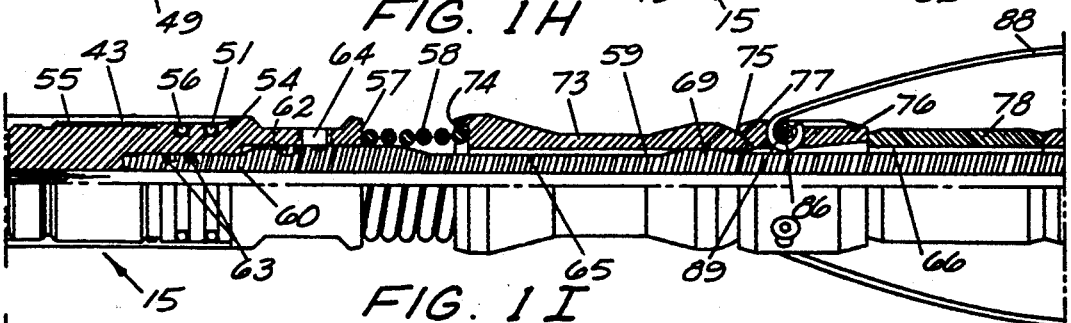
Figure 1J:
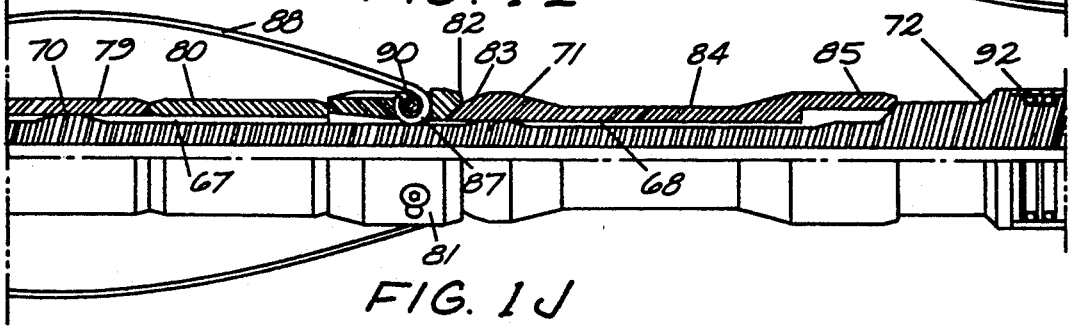
Figure 1K:
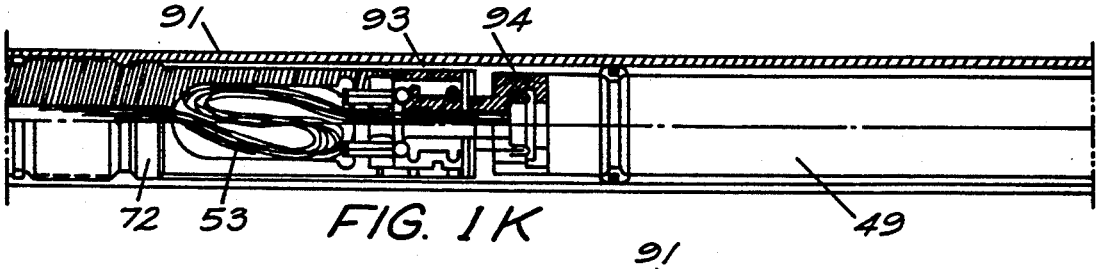
Figure 1L:
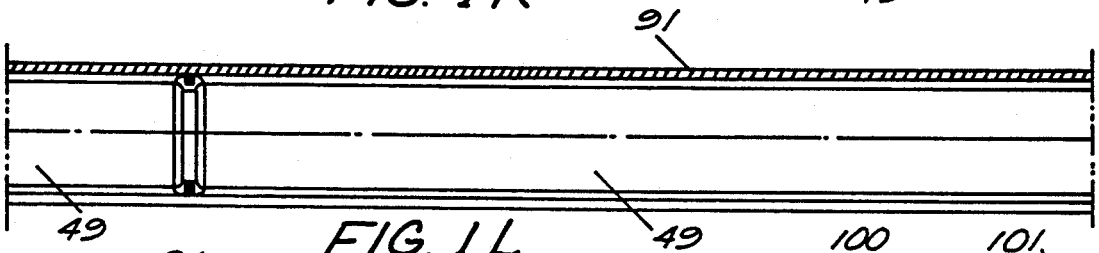
Figure 1M:
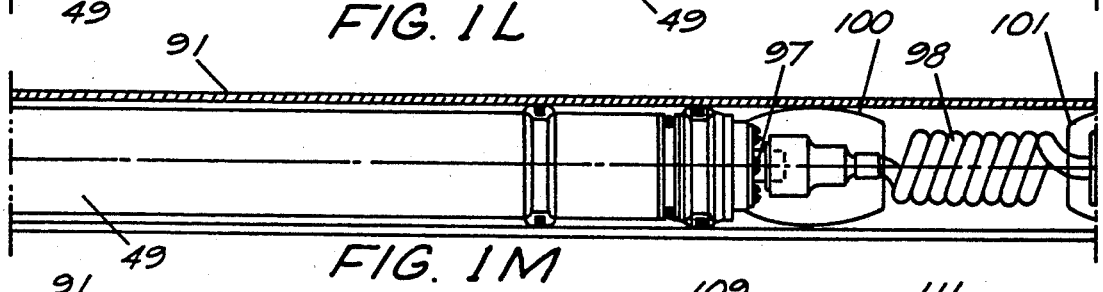
Figure 1N:
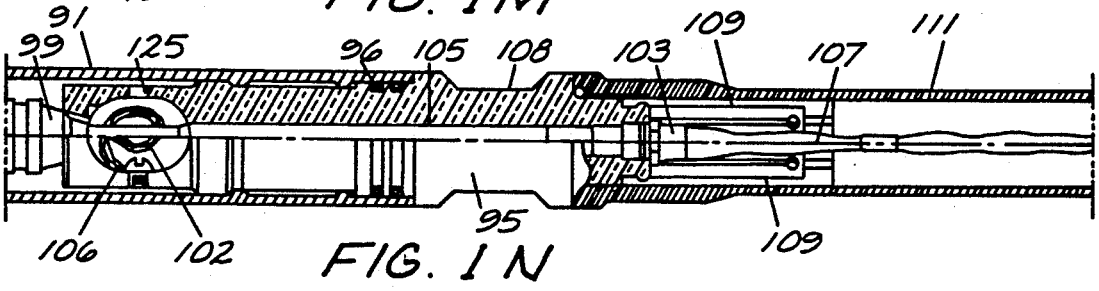
Figure 1P:
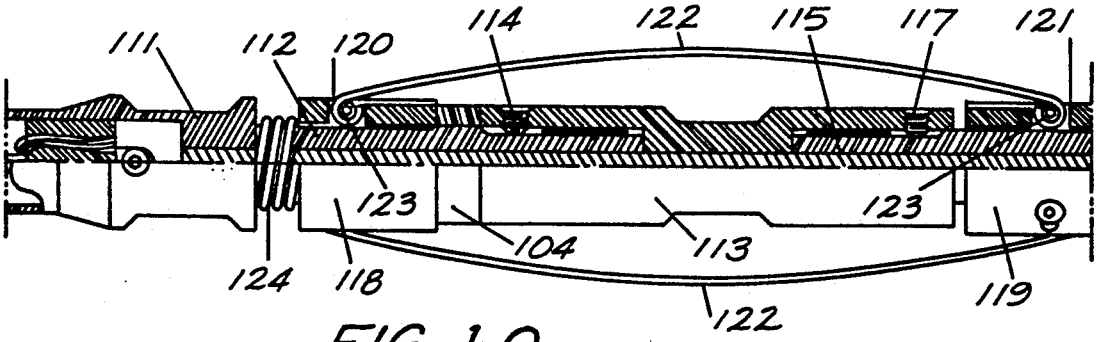
Figure 1P:
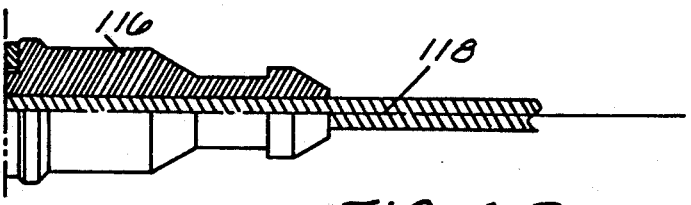
Figure 2A:
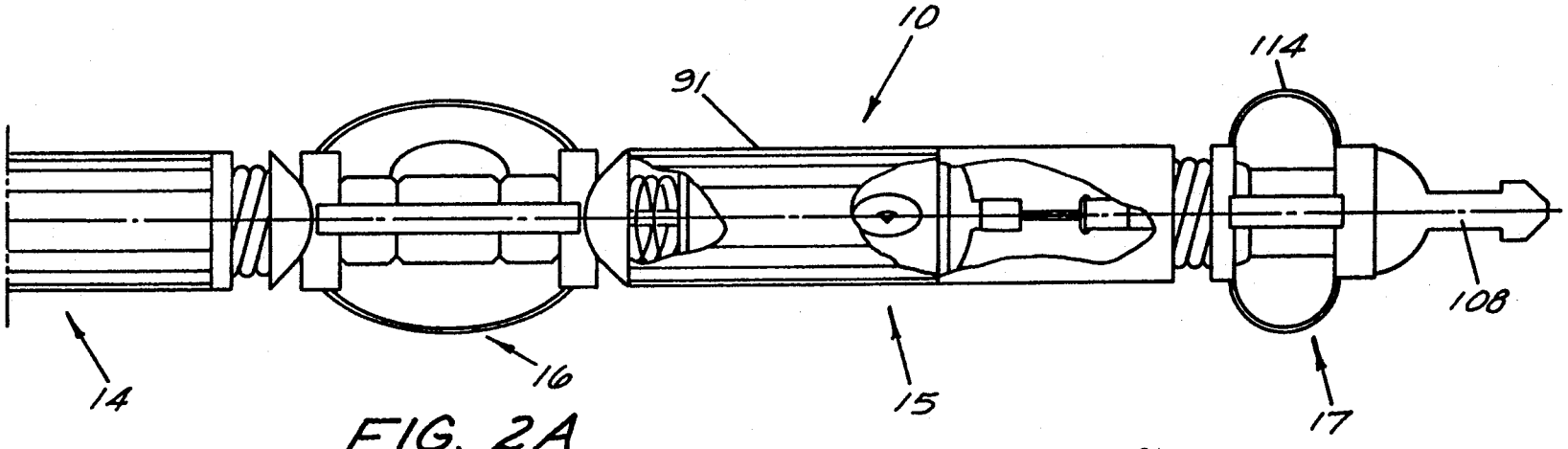
FIGS. 2A and 2B are views, partially in elevation and partially with the housings broken open, showing the tool of FIGS. 1A through 1P in its complete length.
Figure 2B:
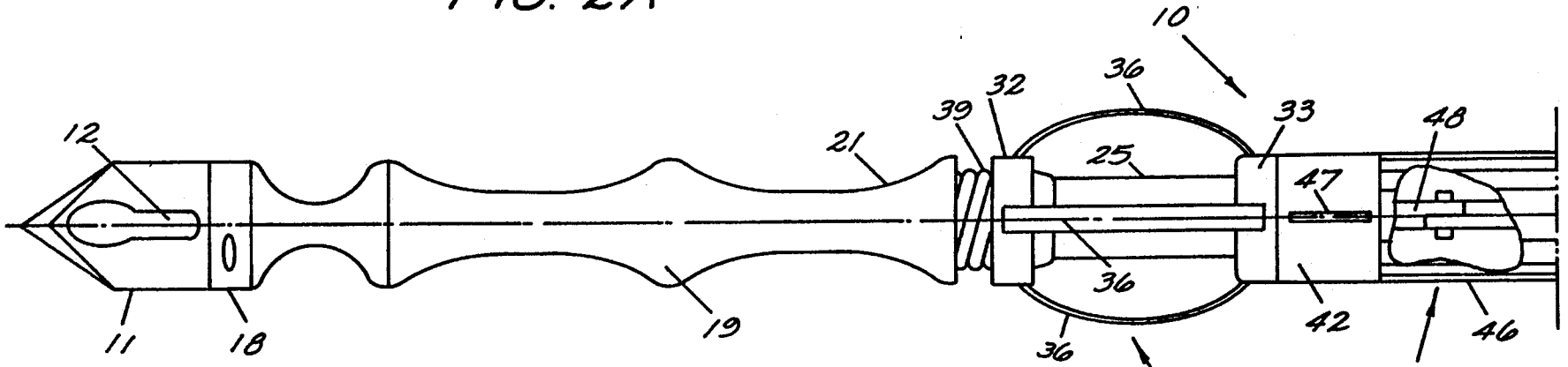

The short radius directional tool as seen in FIGS. 1A through 1P of the drawings is designed for short radius directional and horizontal drilling applications. The tool is engineered to eliminate over stress at the pressure barrel sections 43 and 91 due to high angle bending found in short radius curvatures. Over stress at the pressure barrel sections can cause pressure barrel failure due to collapse which in turn will cause electrical component damage to the inner housed electronic probe sections. The short radius directional tool 10 is engineered to bend in preferred or preferential sections thereby eliminating the problem of over stress at the pressure barrel sections. The bending will occur in the preferred sections prior to bending occurring in the pressure barrel sections.

This steering tool and the associated equipment completing the survey system was for horizontal application. The new guidance system has the ability to survey short radius curvatures along with medium length and long length lateral sections. This steering tool and survey system was successfully field tested when it recently directed a drill string through an eighty-four foot radius and then through one thousand feet of lateral section to completion in a period of three days. The following conclusions were drawn from the field test. Short radius curves with long lateral sections are feasible and economical. The use of a wet connect system could extend the lateral section well beyond 1000 ft. The short radius stabilization system worked as designed keeping vibrations to a minimum while giving the drilling engineer the ability to survey as needed within the high angle curve section. The component parts of the short radius survey tool bend in preference to the pressure barrel sections making the tool perform as designed and engineered.

This short radius steering tool has many applications in addition to horizontal drilling. The tool may be used in geothermal drilling for electric power generation; earth sciences study of and monitoring of earth movement with respect to fault movement; environmental science cleaning up of inaccessible polluted areas; coring to test rock strength prior to large scale constructions such as dams; and introduction of chemicals for solution mining.

While this invention has been described fully and completely with special emphasis on certain preferred embodiments, it should be understood that within the scope of the appended claims the invention may be practiced otherwise than as specifically described.

We claim:

1. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of housing sections connectable at one end to an orientation sub for a positive displacement motor (PDM) drill and connectable at the other end to a wire line connector, an electronics assembly including guidance directional sensors and probe positioned in a plurality of said housing sections, interconnected electrically, and connected at one end to said wire line connector, selected housing sections spaced along the length of said housing having portions intermediate their respective ends of sufficiently reduced outside diameter to bend in preference to bending of said housing sections containing said electronics assembly, and said steering sub being operable during drilling to bend along its length at said reduced outside diameter housing sections on a short radius without bending said electronics assembly, said selected housing sections including supporting sleeve members in spaced relation thereon and bow spring stabilizers spaced around the periphery of and extending between said sleeve members, and a coil spring engageable with an end of one of said sleeve members and urging it longitudinally to bow said bow spring stabilizer in use to engage the well casing in which said steering sub is operated to maintain a predetermined frictional force against the casing.

2. A flexible steering sub according to claim 1 in which said housing and said electronics assembly are of non-magnetic material.

3. A flexible steering sub according to claim 1 in which selected housing sections include spring stabilizer means engageable with the well casing in which said steering sub is operated to maintain a predetermined frictional force against the casing, and one of said housing sections includes articulated sleeve members thereon positioned within said spring stabilizer means.

4. A flexible steering sub according to claim 3 in which said one housing section interconnects the housing sections containing separate sections of said electronics assembly.

5. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of housing sections connectable at one end to an orientation sub for a PDM drill and connectable at the other end to a wire line connector, an electronics assembly including guidance directional sensors and probe positioned in a plurality of said housing sections, interconnected electrically, and connected at one end to said wire line connector, selected housing sections spaced along the length of said housing having portions intermediate their respective ends of sufficiently reduced outside diameter to bend in preference to bending of said housing sections containing said electronics assembly, and said steering sub being operable during drilling to bend along its length at said reduced outside diameter housing sections on a short radius without bending said electronics assembly, selected housing sections including spring stabilizer means engageable with the well casing in which said steering sub is operated to maintain a predetermined frictional force against the casing, and one of said housing sections including articulated sleeve members thereon positioned within said spring stabilizer means, said one housing section having spaced portions with the surface undercut to define a peripheral boss midway along its length, one sleeve member being supported loosely on said boss, and sleeve members on opposite sides of said one sleeve member overlying said undercut surface.

6. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of housing sections connectable at one end to an orientation sub for a PDM drill and connectable at the other end to a wire line connector, an electronics assembly including guidance directional sensors and probe positioned in a plurality of said housing sections, interconnected electrically, and connected at one end to said wire line connector, selected housing sections spaced along the length of said housing having portions intermediate their respective ends of sufficiently reduced outside diameter to bend in preference to bending of said housing sections containing said electronics assembly, and said steering sub being operable during drilling to bend along its length at said reduced outside diameter housing sections on a short radius without bending said electronics assembly, selected housing sections including bow spring stabilizers spaced around the periphery thereof and engageable with the well casing in which said steering sub is operated to maintain a predetermined frictional force against the casing, one of said housing sections including articulated sleeve members thereon positioned within said bow spring stabilizer, said one housing section has spaced portions with the surface undercut to define a peripheral boss midway along its length, one sleeve member being supported loosely on said boss, and sleeve members on opposite sides of said one sleeve member overlying said undercut surface.

7. A flexible steering sub according to claim 6 in which said one housing section interconnects the housing sections containing separate sections of said electronics assembly.

8. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of housing sections connectable at one end to an orientation sub for a PDM drill and connectable at the other end to a wire line connector, an electronics assembly including guidance directional sensors and probe positioned in a plurality of said housing sections, interconnected electrically, and connected at one end to said wire line connector, selected housing sections spaced along the length of said housing having portions intermediate their respective ends of sufficiently reduced outside diameter to bend in preference to bending of said housing sections containing said electronics assembly, and said steering sub being operable during drilling to bend along its length at said reduced outside diameter housing sections on a short radius without bending said electronics assembly, said selected housing sections including supporting sleeve members in spaced relation thereon and bow spring stabilizers spaced around the periphery of and extending between said sleeve members, and a coil spring engageable with an end of one of said sleeve members and urging it longitudinally to bow said bow spring stabilizer in use to engage the well casing in which said steering sub is operated to maintain a predetermined frictional force against the casing, and one of said housing sections including articulated sleeve members thereon positioned within said bow spring stabilizer.

9. A flexible steering sub according to claim 8 in which said one housing section has spaced portions with the surface undercut to define a peripheral boss midway along its length, one sleeve member being supported loosely on said boss, and sleeve members on opposite sides of said one sleeve member overlying said undercut surface.

10. A flexible steering sub according to claim 8 in which said one housing section interconnects the housing sections containing separate sections of said electronics assembly.

11. A flexible steering sub according to claim 10 in which said housing sections comprise in sequence from bottom to top a mule shoe stinger shaped to key into an orientation sub on a drilling assembly, a mechanical alignment tool, a sinker bar, a lower stabilizer, a lower pressure barrel, a mid stabilizer, an upper pressure barrel, an upper stabilizer, a wire line fishing head, said upper and lower pressure barrels containing separate sections of said electronics assembly and connections therefor, said upper, lower and mid stabilizers, and said sinker bar comprising the selected housings having said portions of reduced outside diameter.

12. A flexible steering sub according to claim 11 in which said housing and said electronics assembly are of non-magnetic material.

13. A flexible steering sub according to claim 11 in which said stabilizers include spring stabilizer means engageable with the well casing in which said steering sub is operated to maintain a predetermined frictional force against the casing.

14. A flexible steering sub according to claim 11 in which said stabilizers include bow springs spaced around the periphery thereof and engageable with the well casing in which said steering sub is operated to maintain a predetermined frictional force against the casing.

15. A flexible steering sub according to claim 14 in which said stabilizers include movable concave and convex-ended sleeve members spaced thereon, a coil spring engageable with an end of one of said sleeve members and urging it longitudinally to bow said bow springs in use to engage the well casing in which said steering sub is operated to maintain a predetermined frictional force against the casing.

16. A flexible steering sub according to claim 11 in which said stabilizers include spring stabilizer means engageable with the well casing in which said steering sub is operated to maintain a predetermined frictional force against the casing, and said mid stabilizer includes articulated spherically ended sleeve members thereon positioned within said spring stabilizer means.

17. A flexible steering sub according to claim 16 in which said mid stabilizer has spaced portions with the surface undercut to define a peripheral boss midway along its length, one sleeve member being supported loosely on said boss, and sleeve members on opposite sides of said one sleeve member overlying said undercut surface.

18. A flexible steering sub according to claim 16 in which said mid stabilizer interconnects said pressure barrels containing separate sections of said electronics assembly.

19. A flexible steering sub according to claim 11 in which said stabilizers have bow springs spaced around the periphery thereof and engageable with the well casing in which said steering sub is operated to maintain a predetermined frictional force against the casing, and one of said stabilizers includes articulated sleeve members thereon positioned within said bow springs.

20. A flexible steering sub according to claim 19 in which said mid stabilizer has spaced portions with the surface undercut to define a peripheral boss midway along its length, one sleeve member being supported loosely on said boss, and sleeve members on opposite sides of said one sleeve member overlying said undercut surface.

21. A flexible steering sub according to claim 19 in which said mid stabilizer interconnects the pressure barrels containing separate sections of said electronics assembly.

22. A flexible steering sub according to claim 11 in which said stabilizers include supporting spherically ended sleeve members in spaced relation thereon and bow springs spaced around the periphery of and extending between said sleeve members, and a coil spring engageable with an end of one of said spherically ended sleeve members and urging it longitudinally to bow said bow springs in use to engage the well casing in which said steering sub is operated to maintain a predetermined frictional force against the casing, and said mid stabilizer includes articulated spherically ended sleeve members thereon positioned within said bow springs.

23. A flexible steering sub according to claim 22 in which said mid stabilizer has spaced portions with the surface undercut to define a peripheral boss midway along its length, one sleeve member being supported loosely on said boss, and sleeve members on opposite sides of said one sleeve member overlying said undercut surface.

24. A flexible steering sub according to claim 22 in which said mid stabilizer interconnects the pressure barrels containing separate sections of said electronics assembly.

25. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of sections connectable at one end to an orientation sub for a PDM drill and connectable at the other end to a wire line connector and enclosing an electronics assembly, said housing sections comprise in sequence from bottom to top a mule shoe stinger rod shaped to key into an orientation sub on a drilling assembly, a mechanical alignment tool rod threadedly attached to said mule shoe stinger rod, a sinker bar threadedly attached to said alignment tool rod, a lower stabilizer rod comprising a plurality of sections assembled together, and having a mid portion of reduced diameter relative to the ends thereof, a pair of movable sleeve members slidably supported on said lower stabilizer rod, a plurality of bow springs spaced around the periphery of said stabilizer rod and having opposite ends thereof secured in said sleeve members, a first coil spring compressively engaging one of said sleeve members to bow said bow springs in use to engage the well casing in which said steering sub is operated to maintain a predetermined frictional force against the casing, a lower housing section comprising a lower pressure barrel enclosing a lower part of said electronics assembly, and connected at its lower end to said lower stabilizer, a mid stabilizer rod comprising a plurality of sections assembled together, and having spaced portions with the surface undercut to define a peripheral boss midway along its length, and connected at its lower end to the upper end of said lower pressure barrel, one sleeve member being supported loosely on said boss, a pair of sleeve members on opposite sides of said one sleeve member overlying said undercut surface, a plurality of bow springs spaced around the periphery of said mid stabilizer rod and having opposite ends thereof secured in said sleeve members, a second coil spring compressively engaging one of said sleeve members to bow said bow springs in use to engage the well casing in which said steering sub is operated to maintain a predetermined frictional force against the casing, an upper housing section comprising an upper pressure barrel enclosing an upper part of said electronics assembly, and connected at its lower end to the upper end of said mid stabilizer, cable means in said mid stabilizer interconnecting said upper and said lower electronics assembly parts, an upper stabilizer rod comprising a plurality of sections assembled together, and having a mid portion of reduced diameter relative to the ends thereof, and connected at its lower end to the upper end of said upper pressure barrel and at its upper end to said wire line fishing head, a pair of movable sleeve members slidably supported on said upper stabilizer rod, a plurality of bow springs spaced around the periphery of said upper stabilizer rod and having opposite ends thereof secured in said sleeve members, a coil spring compressively engaging one of said sleeve members to bow said bow springs in use to engage the well casing in which said steering sub is operated to maintain a predetermined frictional force against the casing, and said upper, lower and mid stabilizers, and said sinker bar having portions of reduced outside diameter which permit bending in preference to bending said lower and said upper pressure barrels.

26. A flexible steering sub for flexible drilling of horizontal wells, geothermal drilling for electric power generation; earth sciences study of and monitoring of earth movement with respect to fault movement; environmental science cleaning up of inaccessible polluted areas; coring to test rock strength prior to large scale constructions such as dams; introduction of chemicals for solution mining, and the like comprising an elongated housing comprising a plurality of housing sections connectable at one end to an orientation sub for a PDM drill and connectable at the other end to a wire line connector, an electronics assembly including guidance directional sensors and probe positioned in a plurality of said housing sections, interconnected electrically, and connected at one end to said wire line connector, said electrical interconnection including a plug member interconnecting the two housing sections next adjacent to said wire line connector, said plug member including means sealing said housing sections against entrance of external pressure in the region of electrical interconnection, selected housing sections spaced along the length of said housing having portions intermediate their respective ends of sufficiently reduced outside diameter to bend in preference to bending of said housing sections containing said electronics assembly, and said steering sub being operable during drilling to bend along its length at said reduced outside diameter housing sections on a short radius without bending said electronics assembly, said plug member including at least one electrical splice and is packed with inert non-conductive dampening putty to eliminate electrical fraying of the lines due to vibration, a pressure bulkhead feed through pin positioned at the top of said plug member functioning as an external 20,000 psi pressure resistant bulkhead seal, and a bulk head cap positioned on the upper end of said plug member to prevent external pressure from crushing said pressure bulkhead feed through pin.

* * * * *